US011794465B2

(12) United States Patent
Williams et al.

(10) Patent No.: US 11,794,465 B2
(45) Date of Patent: Oct. 24, 2023

(54) FOUNTAIN SOLUTION IMAGING USING DRY TONER ELECTROPHOTOGRAPHY

(71) Applicant: Palo Alto Research Center Incorporated, Palo Alto, CA (US)

(72) Inventors: Antonio St. Clair Lloyd Williams, Mountain View, CA (US); David K. Biegelsen, Portola Valley, CA (US); Eugene Beh, Menlo Park, CA (US)

(73) Assignee: Xerox Corporation, Norwalk, CT (US)

( * ) Notice: Subject to any disclaimer, the term of this patent is extended or adjusted under 35 U.S.C. 154(b) by 151 days.

(21) Appl. No.: 17/384,312

(22) Filed: Jul. 23, 2021

(65) Prior Publication Data

US 2022/0227116 A1 Jul. 21, 2022

Related U.S. Application Data

(60) Provisional application No. 63/139,181, filed on Jan. 19, 2021.

(51) Int. Cl.
*B41F 7/02* (2006.01)
*B41C 1/10* (2006.01)
(Continued)

(52) U.S. Cl.
CPC ..... *B41F 13/08* (2013.01); *B41C 1/1041* (2013.01); *B41F 7/02* (2013.01); *B41F 7/08* (2013.01); *B41F 7/26* (2013.01); *B41F 31/002* (2013.01); *B41F 31/08* (2013.01); *B41F 31/13* (2013.01); *B41J 2/33535* (2013.01); *B41J 2/34* (2013.01); *B41M 1/06* (2013.01); *B41N 3/03* (2013.01);
(Continued)

(58) Field of Classification Search
CPC .. B41C 1/1033; B41C 1/1041; B41J 2/33515; B41J 2/33535; B41J 2/34; B41F 7/02; B41F 7/08; B41F 7/26; B41F 31/002; B41F 31/08; B41F 31/13
See application file for complete search history.

(56) References Cited

U.S. PATENT DOCUMENTS 2,551,582 A 5/1951 Carlson
8,958,723 B2 2/2015 Liu
(Continued)

*Primary Examiner* — Jennifer Bahls
*Assistant Examiner* — Quang X Nguyen
(74) *Attorney, Agent, or Firm* — Caesar Rivise, PC

(57) ABSTRACT

Fountain solution latent images are provided on an inking blanket without using laser-induced evaporation systems. Approaches include a rotatable charge retentive surface configured to receive an unfused toned electrostatic pattern of toner particles adhered thereto via electrophotography. The toner includes small diameter polymeric or inorganic particles that may have no color pigment to appear transparent or translucent. Fountain solution is disposed on at least one of the toner, the charge retentive surface and a transfer substrate. The transfer substrate is adjacent the charge retentive surface and forms a nip therebetween, with the transfer substrate sandwiching the unfused toned electrostatic pattern of toner particles and fountain solution against the charge retentive surface at the nip. Fountain solution sandwiched between the surfaces splits as the surfaces separate downstream the nip, leaving a fountain solution latent image remaining on the transfer member surface based on the electrostatic charged pattern on the charge retentive surface.

20 Claims, 10 Drawing Sheets

(51) Int. Cl.

| | |
|---|---|
| ***B41F 7/26*** | (2006.01) |
| ***B41F 31/00*** | (2006.01) |
| ***B41F 13/08*** | (2006.01) |
| ***B41J 2/34*** | (2006.01) |
| ***B41J 2/335*** | (2006.01) |
| ***B41F 7/08*** | (2006.01) |
| ***B41M 1/06*** | (2006.01) |
| ***B41F 31/13*** | (2006.01) |
| ***B41F 31/08*** | (2006.01) |
| ***B41N 3/03*** | (2006.01) |

(52) U.S. Cl.
CPC ..... *B41C 1/1033* (2013.01); *B41P 2227/70* (2013.01)

(56) References Cited

U.S. PATENT DOCUMENTS

| | | | | |
|---|---|---|---|---|
| 9,316,993 | B2 | 4/2016 | Veres et al. | |
| 10,744,754 | B2 | 8/2020 | Williams et al. | |
| 2012/0103212 | A1 | 5/2012 | Stowe et al. | |
| 2012/0103221 | A1 | 5/2012 | Stowe et al. | |
| 2013/0033686 | A1 | 2/2013 | Stowe et al. | |
| 2014/0013980 | A1 | 1/2014 | Veres et al. | |
| 2017/0217150 | A1 | 8/2017 | Moore et al. | |
| 2019/0329582 | A1* | 10/2019 | Lestrange ..... | B41F 13/22 |

* cited by examiner

FOUNTAIN SOLUTION IMAGING USING DRY TONER ELECTROPHOTOGRAPHY

FIELD OF DISCLOSURE

The present disclosure is related to marking and printing systems, and more specifically to variable data lithography system using fog development of an electrographic image for creating a fountain solution image.

BACKGROUND

Offset lithography is a common method of printing today. For the purpose hereof, the terms "printing" and "marking" are interchangeable. In a typical lithographic process a printing plate, which may be a flat plate, the surface of a cylinder, belt and the like, is formed to have image regions formed of hydrophobic and oleophilic material, and non-image regions formed of a hydrophilic material. The image regions are regions corresponding to areas on a final print (i.e., the target substrate) that are occupied by a printing or a marking material such as ink, whereas the non-image regions are regions corresponding to areas on the final print that are not occupied by the marking material.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778.

A variable data lithography (also referred to as digital lithography) printing process usually begins with a fountain solution used to dampen a silicone imaging plate or blanket on an imaging drum. The fountain solution forms a film on the silicone plate that is on the order of about one (1) micron thick. The drum rotates to an exposure station where a high-power laser imager is used to remove the fountain solution at locations where image pixels are to be formed. This forms a fountain solution based latent image. The drum then further rotates to an inking station where lithographic-like ink is brought into contact with the fountain solution based latent image and ink transfers into places where the laser has removed the fountain solution. The ink is usually hydrophobic for better adhesion on the plate and substrate. An ultraviolet (UV) light may be applied so that photo-initiators in the ink may partially cure the ink to prepare it for high efficiency transfer to a print media such as paper. The drum then rotates to a transfer station where the ink is transferred to a print substrate such as paper. The silicone plate is compliant, so an offset blanket is not needed to aid transfer. UV light may be applied to the paper with ink to fully cure the ink on the paper. The ink is on the order of one (1) micron pile height on the paper.

The formation of the image on the printing plate/blanket is usually done with imaging modules each using a linear output high power infrared (IR) laser to illuminate a digital light projector (DLP) multi-mirror array, also referred to as the "DMD" (Digital Micromirror Device). The laser provides constant illumination to the mirror array. The mirror array deflects individual mirrors to form the pixels on the image plane to pixel-wise evaporate the fountain solution on the silicone plate to create the fountain solution latent image.

Due to the need to evaporate the fountain solution to form the latent image, power consumption of the laser accounts for the majority of total power consumption of the whole system. The laser power that is required to create the digital pattern on the imaging drum via thermal evaporation of the fountain solution to create a latent image is particularly demanding (30 mW per 20 um pixel, ~500 W in total). The high power laser module adds a significant cost to the system; it also limits the achievable print speed to about five meters per second (5 m/s) and may compromise the lifetime of the exposed components (e.g., micro-mirror array, imaging blanket, plate, or drum).

For the reasons stated above, and for other reasons which will become apparent to those skilled in the art upon reading and understanding the present specification, it would be beneficial to increase speed and lower power consumption in variable data lithography system.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a device for making a fountain solution latent image including a charge retentive surface and a transfer substrate. The charge retentive surface has an unfused toned electrostatic pattern of toner particles adhered thereto via electrophotography. The transfer substrate is adjacent the charge retentive surface and forms a nip therebetween, with the transfer substrate configured to sandwich the unfused toned electrostatic pattern of toner particles and fountain solution against the charge retentive surface at the nip. The charge retentive surface and the transfer substrate separate downstream the nip. Upon the separation, the unfused toned electrostatic pattern of toner particles remains on the charge retentive surface only and the transfer substrate remains wetted with the fountain solution patterned as the fountain solution latent image based on the electrostatic pattern.

According to aspects illustrated herein, an exemplary method for making a fountain solution latent image is discussed. The method includes: generating an unfused toned electrostatic pattern of toner particles on a charge retentive surface, sandwiching the unfused toned electrostatic pattern of toner particles and fountain solution at a nip between the charge retentive surface and a transfer substrate, the transfer substrate being wetted with the fountain solution, and separating the charge retentive surface from the transfer substrate downstream the nip, wherein upon the separation the unfused toned electrostatic pattern of toner particles remains on the charge retentive surface only and the transfer substrate remains wetted with the fountain solution patterned as a fountain solution latent image based on the electrostatic pattern.

According to aspects described herein, a system for making a fountain solution latent image including a processor and a memory is discussed. The memory is configured to store instructions to cause the processor to generate an unfused toned electrostatic pattern of toner particles on a charge retentive surface, sandwich the unfused toned electrostatic pattern of toner particles and fountain solution at a nip between the charge retentive surface and a transfer substrate, the transfer substrate being wetted with the fountain solution, and separate the charge retentive surface from the transfer substrate downstream the nip. Upon the separation, the unfused toned electrostatic pattern of toner particles remains on the charge retentive surface only and the transfer substrate remains wetted with the fountain solution patterned as a fountain solution latent image based on the electrostatic pattern.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION OF THE INVENTION

Figure 1:
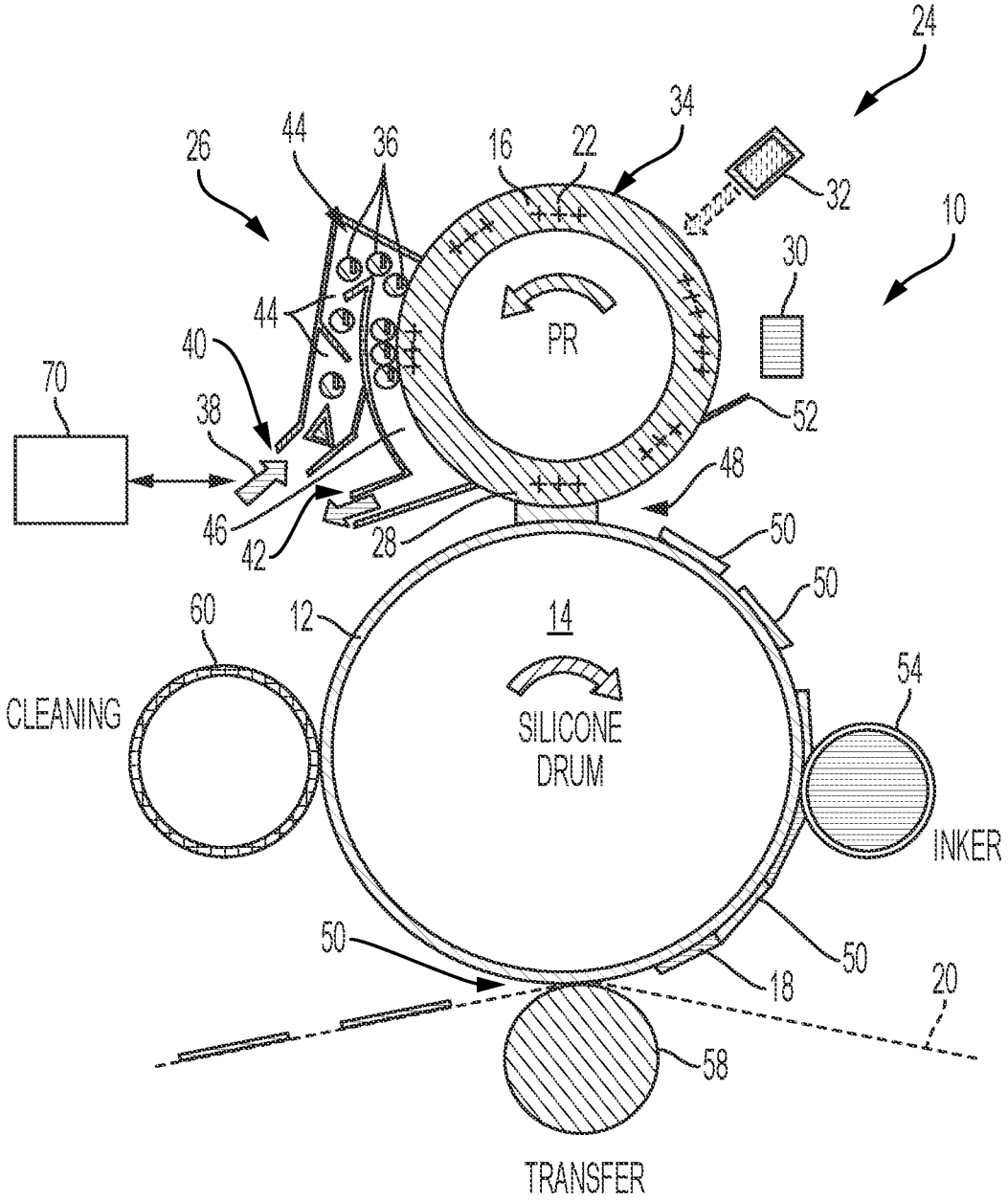
FIG. 1 illustrates a diagram of a related art ink-based digital printing system.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASIC s), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roll) of an image forming device to affect connection of a marking material (e.g., ink, pigmented toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. The fountain solution may be non-aqueous including, for example, silicone fluids (such as D3, D4, D5, OS10, OS20, OS30 and the like), Isopar fluids, and polyfluorinated ether or fluorinated silicone fluid.

The term "aerosol" refers to a suspension of solid and/or liquid particles in a gas. An aerosol may include both the particles and the suspending gas, which may be air, another gas or mixture thereof. The solids and/or liquid particles are sufficiently large for sedimentation, for example, as fountain solution on an imaging member surface. For example, solid or liquid particles may be greater than 0.1 micron, less than 5 microns, between about 0.5 and 2 microns and about 1 micron in diameter.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

FIG. 1 depicts an exemplary related art ink-based digital image forming apparatus 10 for variable data lithography including fog development of a charged fountain solution aerosol that forms a latent digital image created electrographically. The latent digital image is transferred to an inking blanket 12 of a transfer member 14 (e.g., roller, cylinder, drum) downstream an imaging member 16 for subsequent printing of an associated ink image 18 onto a print substrate 20. The imaging member 16 shown in FIG. 1 is a drum, but this exemplary depiction should not be read in a manner that precludes the imaging member 16 being a blanket, a belt, or of another known configuration. The image forming apparatus 10 includes the rotatable imaging member 16 having an arbitrarily reimageable surface 22 as different images can be created on the surface layer. In examples, the surface 22 is a charge retentive surface such as but not limited to a photoreceptor surface or a dielectric surface. The reimageable charge retentive surface 22 may be part of the drum or formed over a structural mounting layer that may be, for example, a cylindrical core, or one or more structural layers over a cylindrical core. The reimageable charge retentive surface may be formed of a relatively thin layer over the mounting layer, a thickness of the relatively thin layer being selected to balance charge retaining performance, durability and manufacturability. The imaging member 16 is surrounded by an imaging station 24 configured to form an electrostatic charged pattern of a latent image on the imaging member surface 22, and an aerosol development device 26 that provides a fog of charged fountain solution aerosol particles that are attracted to the electrostatic charged pattern.

According to examples, fountain solution latent images 28 are created (e.g., xerographically, ionographically) on imaging member 16 and transferred to the inking blanket 12 for further processing. At the imaging station 24, a charging device 30 charges the imaging member surface 22, for example by corona discharge from a high voltage power source via a conductor of the charging device adjacent the charge retentive imaging member surface 22. In electrography or xerography an imager 32 having a low power light source (e.g., a laser with a conventional ROS scanner, LED bar) selectively discharges select portions or pixels of the surface 22 according to image data to generate an electrostatic charged pattern 34 disposed on the surface of the imaging member 20. In ionography the imager 32 includes an image projection head for projecting ion beams, i.e., ions of a given polarity, onto the charge retentive surface 22 after the surface is charged by the charging device 30. The surface 22 shown could be a photoreceptor, but when the application is ionographically created, an insulating surface could be used to create the charge image.

The aerosol development device 26 presents a charged patterned uniform layer of fountain solution (e.g., silicone fluids, such as D4, D5, Isopar G, Isopar H, Dowsil OS20, Dowsil OS30, L5; water/IPA mixtures, hydrophilic fluids, and mixtures thereof) aerosol particles 36 in solid or liquid particle form onto the surface 22 of the imaging member 16. The fountain solution aerosol particles 36 are configured to adhere to portions of the imaging member surface 22 according to the electrostatic charged pattern 34 developed thereon by imager 32. In examples, charged fountain solution aerosol particles 36 of opposite polarity of the imaging member surface 22 are deposited onto the electrostatic charged pattern 34, forming a fountain solution latent image 28 on the imaging member surface. In other examples, charged fountain solution aerosol particles 36 of the same polarity as the imaging member surface 22 would be deposited on the neutral pixels thereof.

The aerosol development device 26 atomizes and charges fountain solution 38 into charged fountain solution aerosol particles 36 that enter an inlet port 40. In examples, a pump may supply fountain solution from a container housing the fountain solution to an aerosol generator (e.g., a nebulizer) at a steady, controlled rate. The fountain solution dispensed in FIG. 1 may contain charge control agents (e.g., surfactants, polymer solution, salts), to assist particle charging, as well understood by a skilled artisan. The aerosol development device 26 further includes a manifold having walls 62 defining a chamber 44 and a radially enlarged region 46 near the imaging member surface 22 where a fog of charged fountain solution aerosol particles 36 may carry the atomized fountain solution to the electrostatic charged pattern 34 on the surface of imaging member 16.

A carrier gas such as nitrogen, added in a predetermined amount, may be introduced into the developer unit chamber 44 via inlet port 40 to carry the atomized fountain solution aerosol particles 36 to the surface 22 of imaging member 16 as a gas mixture, where they may be attracted to the electrostatic charged pattern 34 and bond to the charge retentive reimageable surface 22 and form a fountain solution latent image 28. The gas mixture transporting the atomized fountain solution aerosol particles includes the carrier gas and a controlled partial pressure of fountain solution. This partial pressure of fountain solution may solely originate from evaporated fountain solution or a controlled additional vaporized fountain solution. An increase in the partial pressure of the fountain solution will slow down the evaporation from the fountain solution droplets. The partial pressure may be modified, for example, by the controller adding vaporized fountain solution to the gas mixture, as well understood by a skilled artisan.

The surface charge density (created by charging device 30) of the latent image attracts a volume of fountain solution aerosol particles 36 until the surface charge is optionally neutralized or partially neutralized by the fog charged aerosol. Adhesion forces with the imaging member 16 and each other will cause the aerosol particles to remain on the surface 22 of the imaging member.

Aerosol particles 36 do not bond to the surface 22 of imaging member 16 where no latent image charge resides. The aerosol particles 36 can also be electrostatically repelled from uncharged regions of the electrostatic charged pattern 34, for example, via voltage applied to walls of the development device 26. Aerosol particles 36 that do not bond to the imaging member surface 22 may exit the developer unit 20 via outlet port 42 and flow back to the fountain solution container. A vapor vacuum or air knife (not shown) may be positioned adjacent the downstream side of the radially enlarged region 46 near the outlet port 42 to collect unattached aerosol particles and thus avoid leakage of fountain solution into the environment. Reclaimed fountain solution particles can also be condensed and filtered as needed for reuse as understood by a skilled artisan to help minimize the overall use of fountain solution by the image forming device 10.

The transfer member 14 may be configured to form a fountain solution image transfer nip 48 with the imaging member 16. A fountain solution image produced by the developer unit 26 and imaging station 24 on the surface 22 of the imaging member 16 is transferred to the inking blanket 12 of the transfer member 14 under pressure at the loading nip 48. In particular, a light pressure (e.g., a few pounds, greater than 0.1 lbs., less than 10 lbs., about 1-4 lbs.) may be applied between the surface of the inking blanket 12 and the imaging member surface 22. At the fountain solution transfer nip 48, the fountain solution latent image 28 splits as it leaves the nip, and transfers a split layer of the fountain solution latent image, referred to as the transferred fountain solution latent image 50, to the transfer member surface (i.e., inking blanket 12). The amount of fountain solution transferred may be adjusted by contact pressure adjustments of nip 48. For example, a split fountain solution latent image 50 of about one (1) micrometer or less may be transferred to the inking blanket surface. Like the imaging member 16, the transfer member 14 may be electrically biased to enhance loading of the dampening fluid latent image at the loading nip 48.

After transfer of the fountain solution latent image from the imaging member 16, the imaging member 16 may be cleaned in preparation for a new cycle by removing dampening fluid and solid particles from the surface at a cleaning station 52. Various methods for cleaning the imaging member surface 22 may be used, for example an air knife and/or sponge, as well understood by a skilled artisan.

After the fountain solution latent image 50 is transferred to the transfer member 14, ink from an inker 54 is applied to the inking blanket 12 to form an ink pattern or image 18. The inker 54 is positioned downstream fountain solution transfer nip 48 to apply a uniform layer of ink over the transferred fountain solution latent image 50 and the inking blanket 12. While not being limited to a particular theory, the ink pattern or image 18 may correspond to the fountain solution pattern or be a negative thereof. For example, the hiker 54 may deposit the ink to the evaporated pattern representing the imaged portions of the reimageable surface 26, while ink deposited on the unformatted portions of the fountain solution will not adhere based on a hydrophobic and/or oleophobic nature of those portions. The ink image 18 may be transferred to print media or substrate 20 at an ink image transfer nip 56 formed by the transfer member 14 and a substrate transport roll 58. The substrate transport roll 58 may urge the print substrate 20 against the transfer member surface, or inking blanket 12, to facilitate contact transfer of the ink image 18 from the transfer member 14 to the print substrate.

After transfer of the ink image 18 from the transfer member 14 to the print media 20, residual ink may be removed by a cleaning device 60. This residual ink removal is most preferably undertaken without scraping or wearing the imageable surface of the imaging blanket 12. Removal of such remaining fluid residue may be accomplished through use of some form of cleaning device 60 adjacent the imaging blanket 12 between the ink image transfer nip 56 and the fountain solution transfer nip 48. Such a cleaning device 20 may include at least a first cleaning member such as a sticky or tacky roller in physical contact with the imaging blanket surface, with the sticky or tacky roller removing residual fluid materials (e.g., ink, fountain solution) from the surface. The sticky or tacky roller may then be brought into contact with a smooth roller (not shown) to which the residual fluids may be transferred from the sticky or tacky member, the fluids being subsequently stripped from the smooth roller by, for example, a doctor blade or other like device and collected as waste.

It is understood that the cleaning device 60 is one of numerous types of cleaning devices and that other cleaning devices designed to remove residual ink/fountain solution from the surface of imaging blanket 12 are considered within the scope of the embodiments. For example, the cleaning device could include at least one roller, brush, web, belt, tacky roller, buffing wheel, etc., as well understood by a skilled artisan. It is also understood that the cleaning device 60 may be more sophisticated or aggressive at removing residual fluids from imaging blanket 12 that the cleaning station 52 is at removing fountain solution from the surface 22 of the imaging member 16. Cleaning station 52 is not concerned with removing residual ink, and merely is designed to remove fountain solution and associated contaminates from the surface 22.

The exemplary ink-based digital image forming devices and operations thereof may be controlled by a controller 70 in communication with the image forming devices and parts thereof. For example, the controller 70 may control the imaging station 24 to create electrostatic charged patterns of latent images on the imaging member surface 22. Further, the controller 70 may control the aerosol development device 26 or other aerosol development devices discussed in greater detail below to provides the fog of charged fountain solution aerosol particles that are attracted to the electrostatic charged pattern. The controller 70 may be embodied within devices such as a desktop computer, a laptop computer, a handheld computer, an embedded processor, a handheld communication device, or another type of computing device, or the like. The controller 70 may include a memory, a processor, input/output devices, a display and a bus. The bus may permit communication and transfer of signals among the components of the controller 70 or computing device, as will be described in greater detail below.

Additional approaches for creating a fountain solution latent image 28 on the inking blanket 12 are provided, also without using laser-induced fountain solution evaporation. In examples, an unfused toned electrostatic pattern of toner particles are generated on a charge retentive surface, such as the imaging member surface 22 via electrophotography. While not being limited to a particular theory, the toner includes small diameter (e.g., less than 50 microns, averaging less than 10 microns, about 5 microns or less) polymeric or inorganic (e.g., silica) dry particles that may have no color pigment to appear transparent, translucent or colorless. The toner particles may range in stiffness from deformable and compliant to stiff. The toner particles may also range in surface roughness from smooth to rough as understood by a skilled artisan. In addition, the toner particles may have a surface free energy ranging from high to low relative to a surface free energy of the charge retentive imaging member surface 22 as will be discussed in greater detail below.

Fountain solution may be disposed on at least one of the toner, the charge retentive surface and the inking blanket prior to the loading nip 49. A fountain solution latent image with the disposed fountain solution is formed on the inking blanket 12 of the transfer member 14 under pressure at the loading nip 48. For example, at the nip, a light pressure (e.g., a few pounds, greater than 0.1 lbs., less than 10 lbs., about 1-4 lbs.) may be applied between the surface of the inking blanket 12 and the imaging member surface 22. The light pressure sandwiches (e.g., inserts, squeezes) the disposed fountain solution and unfused toned electrostatic pattern of toner particles in the restricted space between the imaging member surface and the inking blanket. Fountain solution sandwiched between the surfaces splits as the surfaces separate downstream the nip, leaving a fountain solution latent image 28 remaining on the transfer member surface (i.e., inking blanket 12). The fountain solution latent image 28 is created on the inking blanket 12 after the nip 48 based on the electrostatic charged pattern 34 on the charge retentive surface 22.

Figure 2:
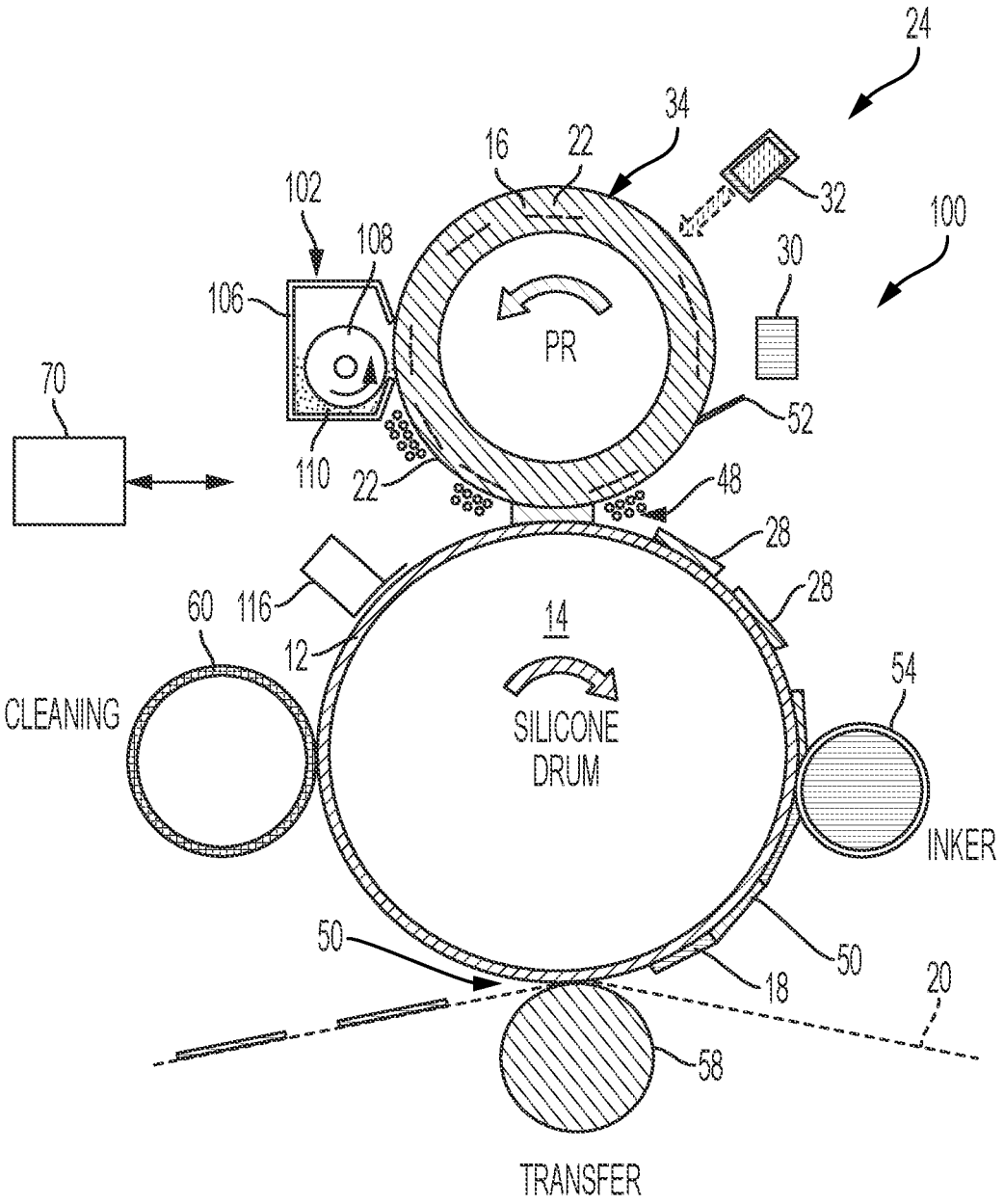
FIG. 2 is a side view partially in cross of a digital image forming device in accordance with examples.

FIG. 2 depicts an exemplary ink-based digital image forming device 100 that creates fountain solution latent image 28 on the inking blanket 12 using an erasure approach. The image forming device 100 is similar to the image forming device 10 discussed above and may use some of the same elements, such as those identified with like referenced numerals. For example, the image forming device 100 includes an imaging member 16 having a charge retentive imageable surface 22 and rotatable in a direction 104 is charged by the charging device 30 and imagewise exposed by imager 32 as described above to form an electrostatic charged pattern 34 on the surface.

Figure 3:
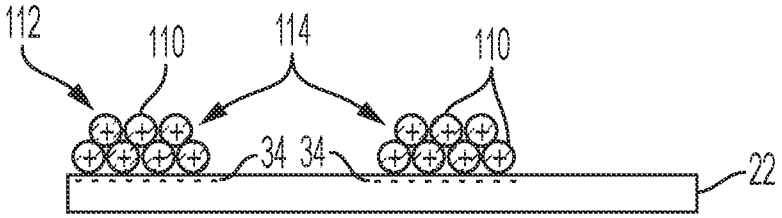
FIG. 3 is a side view partially in cross of an unfused toned electrostatic pattern on a charge retentive surface in accordance with examples.

Downstream the imager 32, the electrostatic charged pattern is developed by a toner dispenser 102 that may include a toner container 106 housing a dispenser roll 108 for applying a supply of toner particles 110 to the charge retentive surface 22. As noted above, the toner 110 includes small diameter polymeric or inorganic particles that may be dry and lack color pigment. There may be no need for pigment because the toner 110 does not mark or become part of a printed image on a substrate. Thus the toner particles 110 may be transparent, translucent or colorless in the visible. The toner particles 110 may attach by attraction to the electrostatic charged pattern 34 and form an unfused toned electrostatic pattern 112 of toner that may group into piles 114 of toner particles having interstices between the particles, as can also be seen by example in FIG. 3.

It should be noted that FIGS. 3-6, 8, and 10 show enlarged portions of elements discussed with reference to at least FIGS. 2, 7 and 9, including the inking blanket 12, charge retentive surface 22, electrostatic charged pattern 34, fountain solution 38, piles 114 of toner particles 110, unfused toned electrostatic pattern 112, fountain solution layer 118, and fountain solution latent image 28 during exemplary fountain solution latent imaging approaches. The elements are not limited to any size, shape, spatial relationships and orientation illustrated in the figures, which are included for even greater understanding of the examples.

The image forming device 100 includes a fountain solution applicator 116 configured to deposit a layer of dampening fluid onto an adjacent surface, which in examples may be the charge retentive surface 22 of the imaging member 16 or the inking blanket 12 of the inked image transfer member 14. While not being limited to particular configurations, the exemplary fountain solution applicator 116 may include a series of rollers (not shown) or sprays (FIG. 1) for uniformly wetting the adjacent surface with a uniform layer of a fountain solution (e.g., dampening fluid), with the thickness of the layer being controlled. The fountain solution applicator may be substantially similar to the aerosol development device 26. While not being limited to a particular theory, in examples after FIG. 1, the fountain solution is at least substantially free of charge control agents (e.g., surfactants, particulates polymer solution, salts) to minimize or inhibit fountain solution charging, as well understood by a skilled artisan. Further, the fountain solution (e.g., silicone fluids, such as D4, D5, Isopar G, Isopar H, Dowsil OS20, Dowsil OS30, L5; water/IPA mixtures, hydrophilic fluids, and mixtures thereof) may have a very low surface free energy. The surface energies of the charge retentive surface 22 may vary and accept or reject fountain solution with widely varying surface energies, for example as described in greater detail below.

Figure 4:
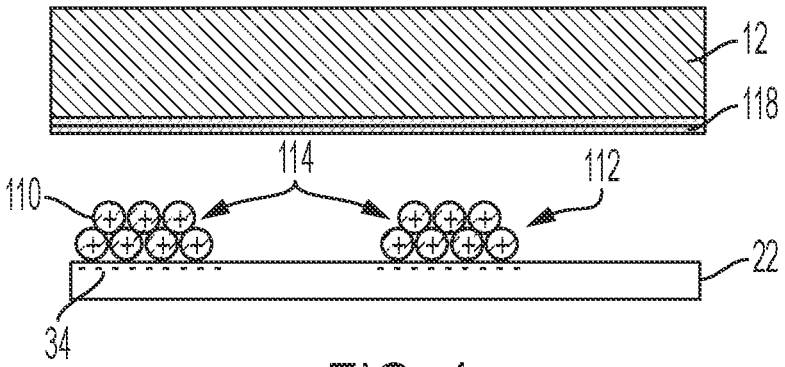
FIG. 4 is a side view partially in cross of a fountain solution layer and unfused toned electrostatic pattern before a nip between an inking blanket and the charge retentive surface.

Referring to FIG. 2, the fountain solution applicator 116 is shown adjacent the inked image transfer member 14 to deposit fountain solution onto the inking blanket 12. The fountain solution may be deposited as a fluid, a vapor and/or an aerosol (i.e., solid or liquid) of particles and condense, melt and/or otherwise wet the exposed outer surface of the inking blanket 12 to form a layer 118 of fountain solution thereon. The fountain solution layer 118 may have a thickness (e.g., less than 500 nm, about 100 nm-400 nm, about 60 nm-150 nm) greater (e.g., about double) than a desired thickness (e.g., about 30 nm-200 nm) left on the blanket at inking, due at least to fountain solution splitting after the nip 48 as will be described in greater detail below. After fountain solution layer 118 deposition and before the nip 48, the fountain solution layer on the inking blanket 12 is spatially separate from the toner 110 attached to the charge retentive surface 22 as can be seen in FIG. 4.

Figure 5:
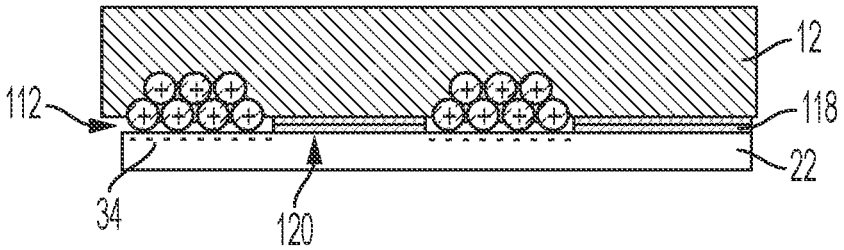
FIG. 5 is a side view partially in cross of the sandwiched fountain solution layer and unfused toned electrostatic pattern of FIG. 4 at the nip.

The rotatable inking blanket 12 (or belt) has a surface in rolling communication with the charge retentive surface 22 at the nip 48. The inking blanket 12 surface may be conformable silicone (e.g., fluorosilicone) and stretchable. Unlike known inking blankets, the inking blanket 12 has no need for carbon loading as the examples do not use laser-induced fountain solution evaporation. FIG. 5 depicts an example of the inking blanket 12 and charge retentive surface at the nip 48, with the unfused toned electrostatic pattern 112 of toner particles 110 and fountain solution layer 118 sandwiched therebetween. The conformable inking blanket 12 may be compressed and form onto the charge retentive surface 22. In the presence of the toner particles 110, fountain solution 38 between the inking blanket 12 and the toner is wicked into the interstices of the toner pile 114. In examples, such as those using ionographical imaging an insulating outer layer of the charge retentive surface may also compress onto the inking blanket 12.

Figure 6:
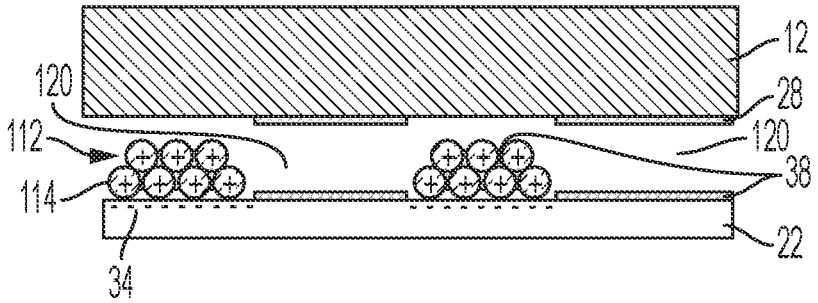
FIG. 6 is a side view partially in cross of a fountain solution latent image after the nip.

FIG. 6 depicts a fountain solution latent image 28 downstream the nip 48. Upon exiting the nip, in sandwiched regions 120 between toner piles 114, the fountain solution layer 118 splits to wet both surfaces (e.g., inking blanket surface and charge retentive surface 22) and leaves about half the prior fountain solution layer thickness on each surface. The amount of fountain solution transferred may be adjusted by contact pressure adjustments of nip 48. The wicked fountain solution 38 remains in the interstices of the toner pile 114, which may leave only a negligible amount of fountain solution behind on the inking blanket 12. The negligible amount of fountain solution can evaporate before inking downstream the nip 48. The interstitial volume within the toner particles in the piles 114 easily accommodates the fountain solution 38 and effectively erases it from the inking blanket like a sponge. This erasure leaves remaining on the inking blanket the fountain solution latent image 28 patterned based on the electrostatic charged pattern 34.

In untoned sandwich regions 120 near the boundaries of toned piles any incomplete inking blanket-charge retentive surface conformation can leave a thicker fountain layer than farther from the boundaries. To the extent that subsequent processes are insensitive to variations in fountain solution thickness, such variations are acceptable and do not affect ink imaging quality. For example, ink rejection by the fountain solution latent image 28 works equally well for fountain solution layer thicknesses in the range of about 50-400 nm.

Toner particles 110 adhesion to the charge retentive surface 22 may be enhanced by the electrostatic field between the electrostatic charged pattern 34 at the surface and toner fixed charge. Further enhanced adhesion of the toner to the charge retentive surface 22 can be achieved by biasing the imaging blanket 12 with a repulsive field. After the transfer nip 48 the toner carrier may be discharged or reversed in polarity and the toner may be removed via the cleaning station 52, dried by heating and/or reduced pressure, and recycled back to the toner dispenser 102. The fountain solution 38 remaining on the charge retentive surface 22 or in the interstices of the toner pile after the nip 48 in the interstices of the toner piles 114 may be removed at the cleaning station 52, reclaimed and also reused, as understood by a skilled artisan.

Figure 7:
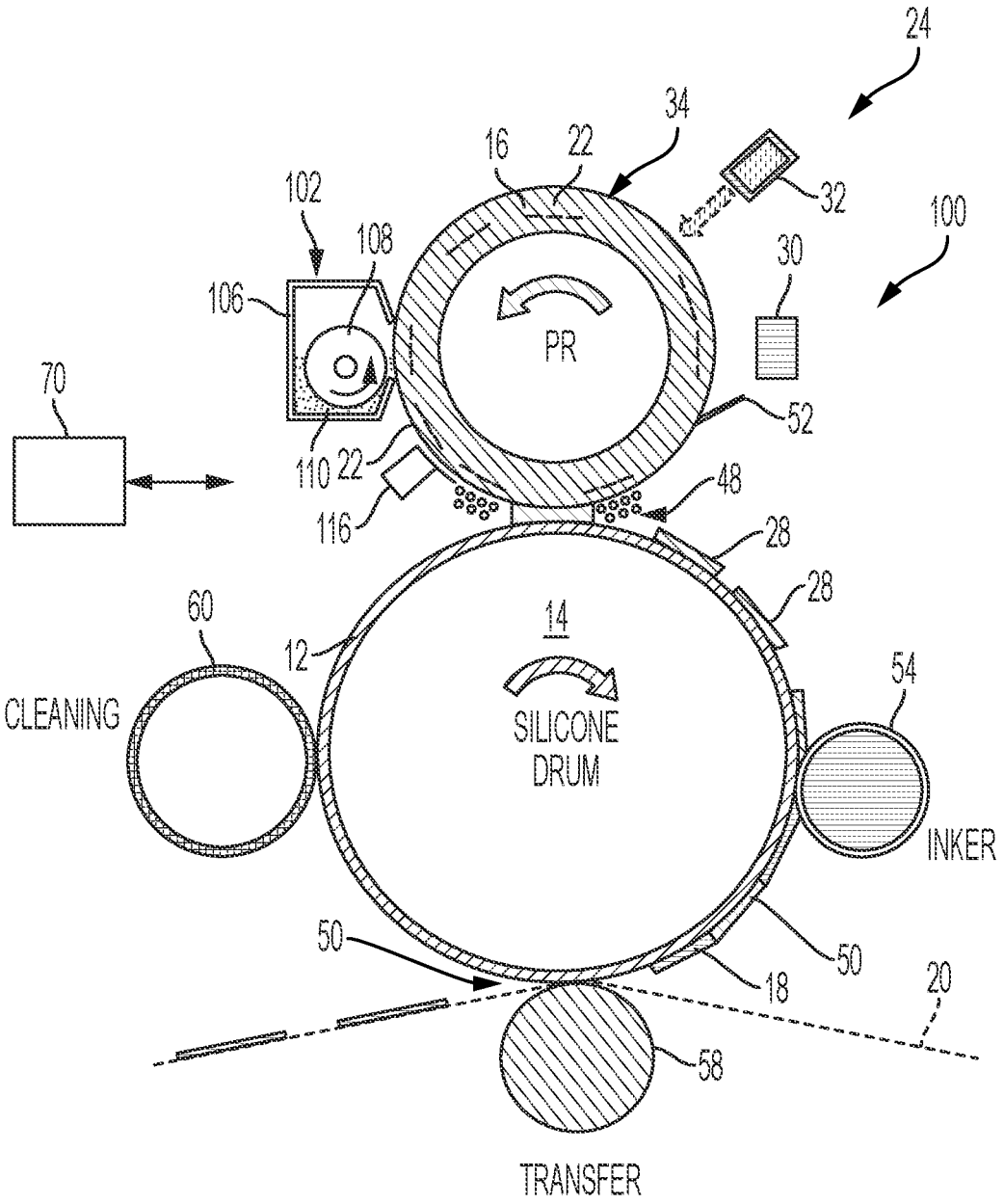
FIG. 7 is a side view partially in cross of another digital image forming device in accordance with examples.

FIG. 7 depicts an exemplary ink-based digital image forming device 125 that creates fountain solution latent image 28 on the inking blanket 12 using a forward transfer approach. The image forming device 125 is similar to the image forming device 100 discussed above and may use some of the same elements, such as those identified with like referenced numerals. For example, the image forming device 125 includes an imaging member 16 having a charge retentive imageable surface 22 and rotatable in a direction 104 is charged by the charging device 30 and imagewise exposed by imager 32 to form an electrostatic charged pattern 34 on the surface. Downstream the imager 32, the electrostatic charged pattern is developed by a toner dispenser 102 for applying a supply of toner particles 110 to the charge retentive surface 22 that form an unfused toned electrostatic pattern 112 thereon.

Figure 8:
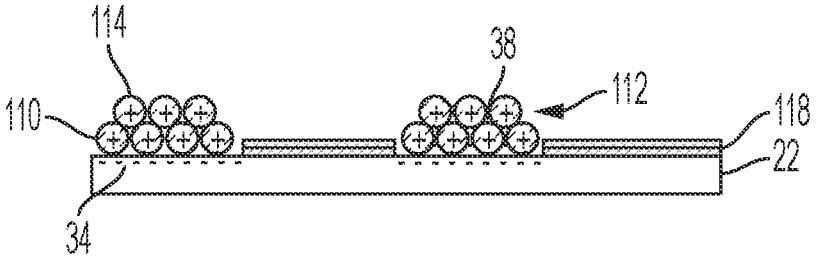
FIG. 8 is a side view partially in cross of an unfused toned electrostatic pattern after fountain solution deposition in accordance with examples.

In the example illustrated in FIG. 7, the fountain solution applicator 116 is shown adjacent the charge retentive imageable surface 22 downstream the toner dispenser 102 to deposit fountain solution onto the charge retentive surface of the imaging member 16 and on the unfused toned electrostatic pattern 112 thereon. The fountain solution may be deposited as a fluid, a vapor and/or an aerosol (i.e., solid or liquid) of particles and condense, melt and/or otherwise wet the unfused toned electrostatic pattern 112. On the surface areas of the charge retentive surface 22 between toner particle piles 114, continuous fountain solution layers 118 are formed having a thickness greater (e.g., about double) than a desired thickness (e.g., about 30 nm-200 nm) left on the inking blanket 12 at inking. Deposited fountain solution 38 that condenses on and/or wets the toner piles 114 is wicked into the interstitial regions between toner particles 110 and away from outer surface areas of the piles. FIG. 8 depicts a portion of the charge retentive surface 22, toner particle piles 114 and fountain solution layers 118 after fountain solution deposition and before the nip 48.

At the nip 48, the inking blanket 12 again may largely conform to the toner carrying surface, with the unfused toned electrostatic pattern 112 and fountain solution layer 118 again sandwiched therebetween as described above and shown by example in FIG. 5. Upon exiting the nip, in sandwiched regions 120 between toner piles 114 the fountain solution layer 118 splits to wet both surfaces. The spitting transfers forward fountain solution onto the inking blanket 12 as the fountain solution latent image patterned based on the electrostatic charged pattern 34. The wicked fountain solution 38 remains trapped in the interstices of the toner pile 114 and essentially does not transfer to the inking blanket 12 (FIG. 6). Again, any negligible amount of fountain solution that transfers from the toner piles can evaporate before inking downstream the nip 48. The interstitial volume within the toner particles in the piles 114 easily accommodates the fountain solution 38 and effectively erases it from the inking blanket like a sponge (FIG. 6).

Referring back to FIG. 7, the exemplary ink-based digital image forming device 125 may be used to create fountain solution latent image 28 on the inking blanket 12 using a modified forward transfer approach. Under this approach the image forming device 125 sets the charge retentive surface 22 and the unfused toned electrostatic pattern 112 of toner particles 110 to a temperature where the probability of vapor condensation on the charge retentive surface is negligible but where the sticking coefficient on the toner is high; that is, the surface energy of the toner is significantly higher than that of the charge retentive surface. By controlling the vapor pressure of FS and the dwell time during which the toner is within the vapor, the toner sponge can be overfilled. Now, when brought into the FS transfer nip a controlled volume of FS can be locally transferred to the blanket. Various alternative embodiments of the present method exist. For example, the toner can be a compressible sponge which is not overfilled but nevertheless transfers FS under pressure within the nip where the interstitial volumes are compressed.

Figure 9:
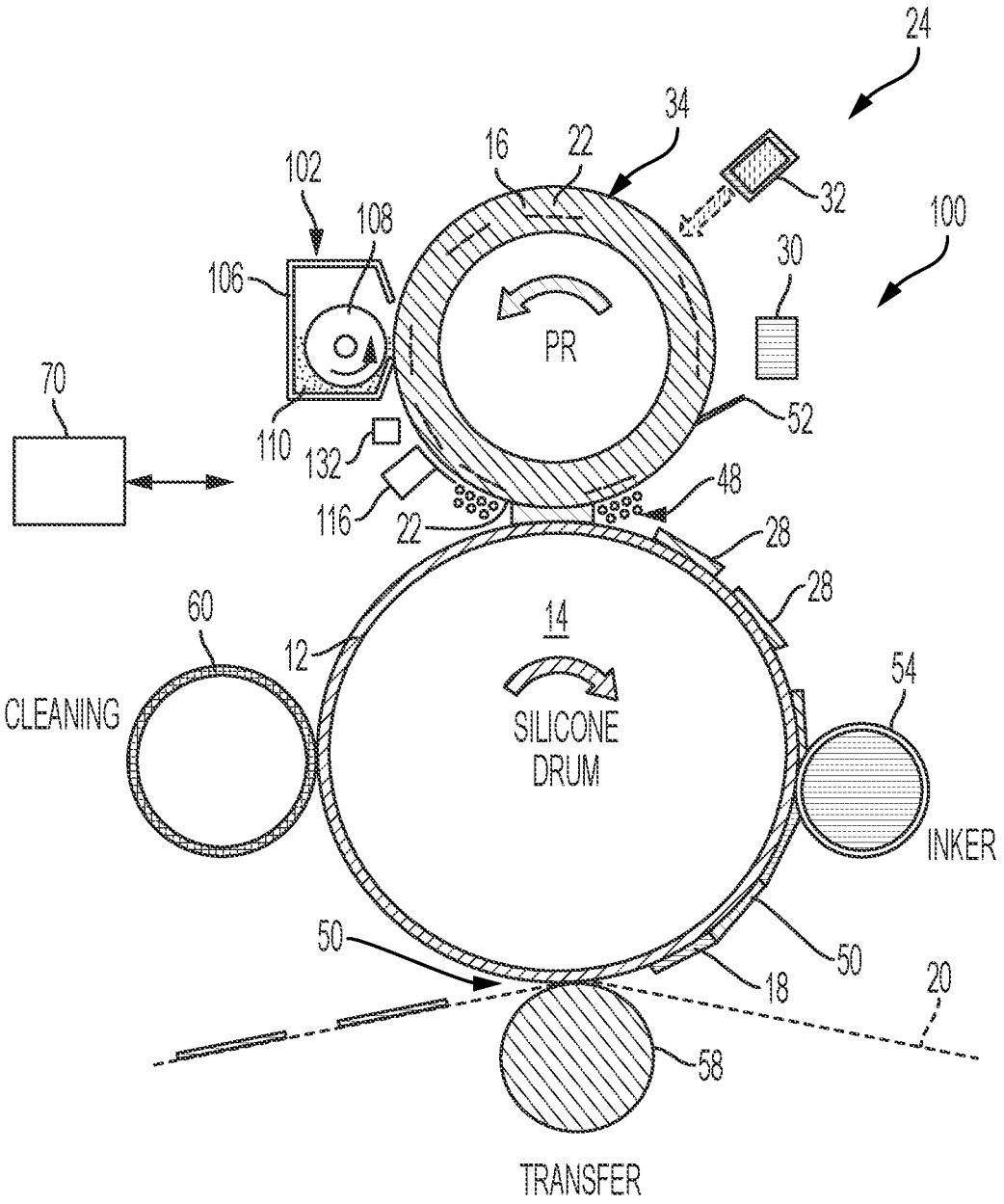
FIG. 9 is a side view partially in cross of yet another digital image forming device in accordance with examples.
Figure 10:
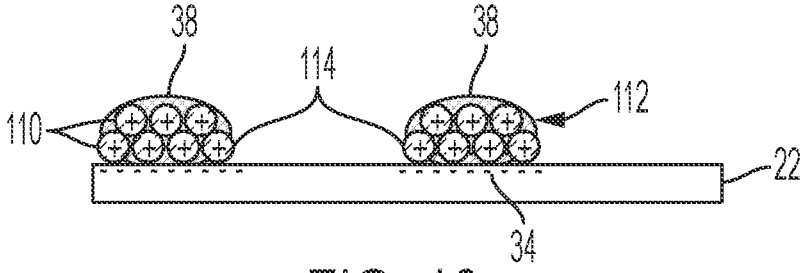
FIG. 10 is a side view partially in cross of an unfused toned electrostatic pattern after fountain solution deposition in accordance with examples.

FIG. 9 depicts an exemplary ink-based digital image forming device 130 that creates fountain solution latent image 28 on the inking blanket 12 using a temperature controlled forward transfer approach. The image forming device 130 is similar to the image forming device 125 discussed above and may use some of the same elements, such as those identified with like referenced numerals. For example, the image forming device 130 includes an imaging member 16 having a charge retentive imageable surface 22 and rotatable in a direction 104 is charged by the charging device 30 and imagewise exposed by imager 32 to form an electrostatic charged pattern 34 on the surface. Downstream the imager 32, the electrostatic charged pattern is developed by a toner dispenser 102 for applying a supply of toner particles 110 to the charge retentive surface 22 that form an unfused toned electrostatic pattern 112 thereon. The fountain solution applicator 116 is adjacent the charge retentive imageable surface 22 downstream the toner dispenser 102 to deposit fountain solution vapor at the charge retentive surface of the imaging member 16 and on the unfused toned electrostatic pattern 112 thereon.

While not being limited to a particular theory, in the examples, the charge retentive surface 22 of the imaging member 16 and the inking blanket of the inked image transfer member 14 may be temperature controlled to aid in the formation of the fountain solution latent image 28, an ink image 18 and any transfer of the images, as well understood by a skilled artisan. Temperature control may be provided internally via fluid within the imaging member 16 and/or the transfer member 14. Further, temperature control may be provided externally, for example, via heating devices, cooling devices and ambient room temperature. In a temperature controlled forward transfer approach according to examples, the temperature of the charge retentive surface 22 may be set to a value or range where the probability of fountain solution vapor condensation ("sticking coefficient") is negligible and a sticking coefficient on the toner particles 110 in the unfused toned electrostatic pattern is high. This is available, for example, when the surface energy of the toner particles 110 is significantly higher than the charge retentive surface 22.

In examples, the charge retentive surface 22 may be set or pre-heated to attain a temperature above the condensation point of the fountain solution for a given pressure, typically about one atm. Referring to FIG. 9, the surface 22 may be heated to a non-condensation temperature, which requires less power than that required for fountain solution evaporation, by a heater 132 (e.g., a raster scanned, intensity modulated laser, a pixelated line laser beam, a vertical cavity surface emitting (VC SET) array, a light emitting diode (LED) array, light source, array of heated pins) to control vapor deposition. The heater may heat the charge retentive surface 22 wholly across the imageable surface or in imagewise fashion, for example, as a negative of the unfused toned electrostatic pattern 112.

Above a certain surface temperature, physisorbed vapor evaporates rapidly leaving an uncoated surface whereas at a slightly lower surface temperature vapor resides long enough to nucleate a liquid film. The surface temperature at which vapor rejection takes place is far lower than that needed to evaporate a liquid film. Also, the temperature difference between that required to reject vapor deposition and allow for vapor deposition is relatively small. Depending on the surface free energies of the charge retentive surface 22 and the fountain solution, the temperature range between sticking and rejection can be as small as, for example, ~5-10° C. and the transition range can lie more than 100° C. below the surface temperature required to rapidly evaporate liquid fountain solution (e.g., about 175° C.). It is understood that the surface energy of the charge retentive surface 22 is lower that the surface energy of the toner particles 110.

A molecule in the vapor approaches the surface and is physisorbed. The molecule is bound to the surface in a potential minimum. The molecule diffuses on the surface as part of a two-dimensional gas of physisorbed molecules. For example, by holding substrate at a temp (e.g., under about 33° C., between about 20-30° C.) that is below the vapor rejection range, it is cold enough to have the vapor stick to surfaces and not bounce off.

Depending on the surface temperature, the molecule frequently attempts to bounce off the surface. If its thermal energy is sufficient to overcome the binding energy, the molecule can depart and may not return. Conversely, if the surface temperature is lower, the probability that the energy of the molecule may allow it to overcome the binding energy peak can be greatly reduced and the density of such molecules can increase. If molecules stay on the surface long enough to find other molecules and overcome a nucleation barrier (i.e., basically, the latent heat of condensation) then the binding energy of such molecules can be greatly increased. Thus, at low surface temperatures, molecules may "stick" and a surface liquid or solid can develop. At slightly higher temperatures molecules can leave the surface before nucleation can occur and the surface can be left basically denuded of molecules.

Still referring to FIG. 9, the heater 132 may be positioned adjacent the charge retentive surface 22 between the toner dispenser 102 and the fountain solution applicator 116. It may be desirable to have the process direction length between the heater 132 and fountain solution applicator 116 as short as possible so that the charge retentive surface 22 does not cool below the vapor rejection range due to conduction into the bulk while still in the presence of fountain solution vapor. It should be noted that in examples where the charge retentive surface is maintained within the fountain solution vapor rejection temperature range, additional heating by heater 132 may not be required.

After the toner dispenser 102 develops an unfused toned electrostatic pattern 112, as discussed above for example, the heater 132 may heat the charge retentive surface 22 to a temperature that inhibits condensation of fountain solution vapor thereon, such as the fountain solution vapor rejection range. The fountain solution applicator 116 deposits fountain solution onto the charge retentive surface of the imaging member 16 and on the unfused toned electrostatic pattern 112 thereon. The deposited fountain solution vapor particles leave the charge retentive surface before nucleation and thus leave at most negligible condensation that can evaporate before inking downstream the nip 48.

The surface energy of the toner particles 110 (e.g., polymeric or inorganic particles) may be significantly higher than that of the charge retentive surface 22. Thus, in examples, deposited fountain solution vapor particles stick to the unfused toned electrostatic pattern 112 of toner particles 110 having a surface energy high enough even after heating to bind and condense the vapor. The interstitial volume within the toner particles in the piles 114 easily accommodates the fountain solution fluid 38 and the toner particle piles—acting like a sponge—may become saturated or oversaturated, as can be seen by example in FIG. 10. In other words, the piles of toner particles physisorb the fountain solution vapor and the condensed fountain solution 38 is wicked into the interstices.

Fountain solution fluid bound by the sponge-like piles 114 of the unfused toned electrostatic pattern 112 is transferred under pressure at the loading nip 48 to the inking blanket 12 as the fountain solution latent image 28. It is understood that the amount of filling or overfilling the sponge-like toner particle piles 114 may be controlled by several approaches, including, for example, controlling the vapor pressure of the fountain solution, the dwell time during which the toner piles 114 are within the vapor, and the temperature of the charge retentive surface 22. In examples, in particular where the toner particle piles 114 are compressible, the toned electrostatic patterned may not need to be saturated to transfer a sufficiently thick (e.g., tens of nanometers) layer of the fountain solution to the inking blanket as the fountain solution latent image. The fountain solution latent image 28 is thus created on the inking blanket 12 after the nip 48 based on a copy of the electrostatic charged pattern 34 on the charge retentive surface 22.

In certain examples, the charge retentive surface 22 may be maintained at a temperature (e.g., lower than the fountain solution vapor rejection range discussed above) that physisorbs condensation of fountain solution vapor thereon and forms a uniformly thick fountain solution layer. In these certain examples, the unfused toned electrostatic pattern 112 of toner particles 110 has a surface free energy lower than a surface free energy of the charge retentive surface 22 such that upon depositing the fountain solution vapor at the charge retentive surface, the unfused toned electrostatic pattern inhibits physisorption of the fountain solution thereon. The fountain solution latent image 28 is created on the inking blanket 12 after the nip 48 based on a negative of the electrostatic charged pattern 34 on the charge retentive surface 22.

Figure 11:
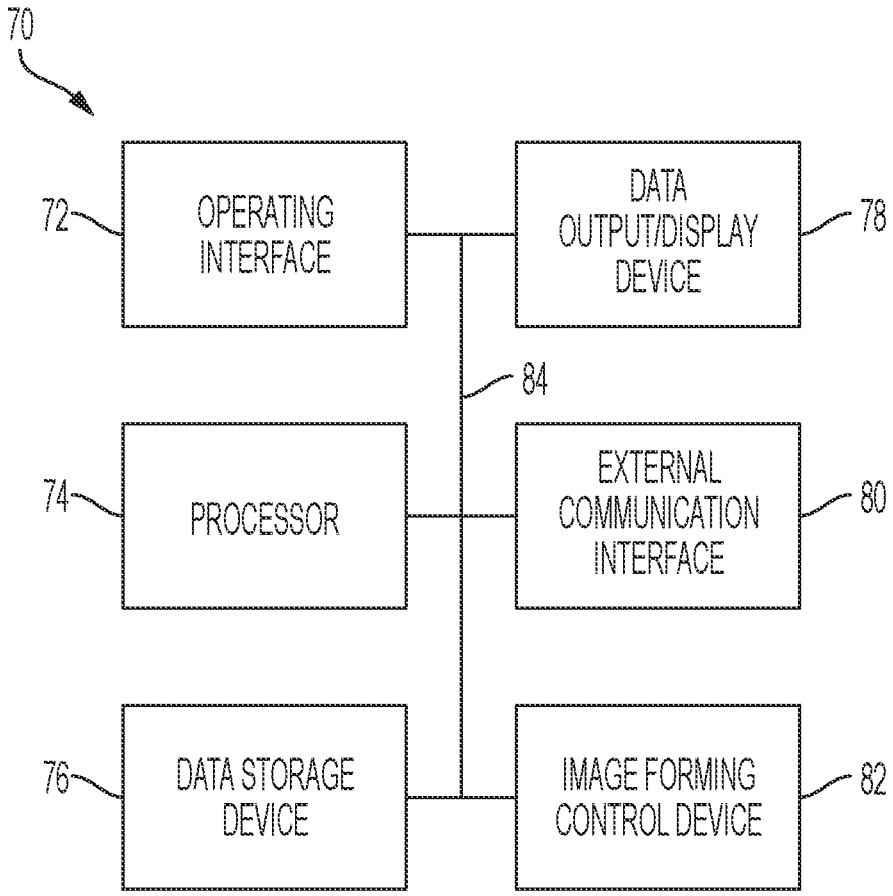
FIG. 11 is a block diagram of a controller with a processor for executing instructions to automatically control components of the exemplary digital image forming devices.

FIG. 11 illustrates a block diagram of the controller 70 for executing instructions to automatically control the ink-based digital image forming devices 10, 100, 125, 130 including the fountain solution aerosol development device 26, the toner dispensers 102, the fountain solution applicators 116, heater 132 and components thereof. The exemplary controller 70 may provide input to or be a component of a controller for executing the image formation method in a system such as that depicted in FIGS. 1-10 and described in greater detail below in FIG. 12.

The exemplary controller 70 may include an operating interface 72 by which a user may communicate with the exemplary control system. The operating interface 72 may be a locally-accessible user interface associated with the digital image forming devices 10, 100, 125, 130. The operating interface 72 may be configured as one or more conventional mechanism common to controllers and/or computing devices that may permit a user to input information to the exemplary controller 70. The operating interface 72 may include, for example, a conventional keyboard, a touchscreen with "soft" buttons or with various components for use with a compatible stylus, a microphone by which a user may provide oral commands to the exemplary controller 70 to be "translated" by a voice recognition program, or other like device by which a user may communicate specific operating instructions to the exemplary controller. The operating interface 72 may be a part or a function of a graphical user interface (GUI) mounted on, integral to, or associated with, the digital image forming devices 10, 100, 125, 130 with which the exemplary controller 70 is associated.

The exemplary controller 70 may include one or more local processors 74 for individually operating the exemplary controller 70 and for carrying into effect control and operating functions for image formation onto a print substrate 20, including but not limited to forming an electrostatic charged pattern 34 on the charge retentive reimageable surface 22, generating an unfused toned electrostatic pattern 112 of toner particles 110 on the charge retentive surface, depositing the fountain solution onto either the charge retentive surface or the transfer substrate, forming a fountain solution latent image on an inking blanket 12 surface of an inked image transfer member 14, depositing a layer of ink over the latent image to form an ink image 18 and transferring the ink image from the inking blanket to print substrate 20. Processor(s) 74 may include at least one conventional processor or microprocessor that interprets and executes instructions to direct specific functioning of the exemplary controller 70, and control of the image forming process with the exemplary controller.

The exemplary controller 70 may include one or more data storage devices 76. Such data storage device(s) 76 may be used to store data or operating programs to be used by the exemplary controller 70, and specifically the processor(s) 74. Data storage device(s) 76 may be used to store information regarding, for example, an image and/or negative of the image for patterning by the imaging station 24, and other digital image information with which the digital image forming devices 10, 100, 125, 130 are associated.

The data storage device(s) 76 may include a random access memory (RAM) or another type of dynamic storage device that is capable of storing updatable database information, and for separately storing instructions for execution of image forming operations by, for example, processor(s) 74. Data storage device(s) 76 may also include a read-only memory (ROM), which may include a conventional ROM device or another type of static storage device that stores static information and instructions for processor(s) 74. Further, the data storage device(s) 76 may be integral to the exemplary controller 70, or may be provided external to, and in wired or wireless communication with, the exemplary controller 70, including as cloud-based data storage components.

The data storage device(s) 76 may include non-transitory machine-readable storage medium to store the device queue manager logic persistently. While a non-transitory machine-readable storage medium is may be discussed as a single medium, the term "machine-readable storage medium" should be taken to include a single medium or multiple media (e.g., a centralized or distributed database, and/or associated caches and servers) that store one or more sets of instructions. The term "machine-readable storage medium" shall also be taken to include any medium that is capable of storing or encoding a set of instruction for execution by the controller 70 and that causes the digital image forming devices 10, 100, 125, 130 to perform any one or more of the methodologies of the present invention. The term "machine-readable storage medium" shall accordingly be taken to include, but not be limited to, solid-state memories, and optical and magnetic media.

The exemplary controller 70 may include at least one data output/display device 78, which may be configured as one or more conventional mechanisms that output information to a user, including, but not limited to, a display screen on a GUI of the digital image forming devices 10, 100, 125, 130 or associated image forming device with which the exemplary controller 70 may be associated. The data output/display device 78 may be used to indicate to a user a status of the digital image forming devices 10, 100, 125, 130 with which the exemplary controller 70 may be associated including an operation of one or more individually controlled components at one or more of a plurality of separate image processing stations or subsystems associated with the image forming device.

The exemplary controller 70 may include one or more separate external communication interfaces 80 by which the exemplary controller 70 may communicate with components that may be external to the exemplary control system such as a temperature sensor, printer or other image forming device. At least one of the external communication interfaces 80 may be configured as an input port to support connecting an external CAD/CAM device storing modeling information for execution of the control functions in the image formation operations. Any suitable data connection to provide wired or wireless communication between the exemplary controller 70 and external and/or associated components is contemplated to be encompassed by the depicted external communication interface 80.

The exemplary controller 70 may include an image forming control device 82 that may be used to control the image forming process to render ink images on the print substrate 20. For example, the image forming control device 82 may: control the imaging station 24 to form an electrostatic charged pattern 34 on the charge retentive reimageable surface 22, control the toner dispenser 102 to generate an unfused toned electrostatic pattern 112 of toner particles 110 on the charge retentive surface, control the fountain solution applicator 116 to deposit the fountain solution onto either the charge retentive surface or the transfer substrate, control the imaging member 16, the transfer member 14 and nip 48 therebetween to form a fountain solution latent image on an inking blanket 12 surface of an inked image transfer member 14, control the inker 54 to deposit a layer of ink over the latent image to form an ink image 18, and control transfer member 14 and print substrate to transfer the ink image from the inking blanket to the print substrate. The image forming control device 82 may operate as a part or a function of the processor 74 coupled to one or more of the data storage devices 76 and the digital image forming devices 10, 100, 125, 130 (e.g., imaging station 24, toner dispenser 102, fountain solution applicator 116, cleaning station 52, hiker 54), or may operate as a separate stand-alone component module or circuit in the exemplary controller 70.

All of the various components of the exemplary controller 70, as depicted in FIG. 11, may be connected internally, and to the digital image forming devices 10, 100, 125, 130 and/or components thereof, by one or more data/control busses 84. These data/control busses 84 may provide wired or wireless communication between the various components of the image forming devices 10, 100, 125, 130 and any associated image forming apparatus, whether all of those components are housed integrally in, or are otherwise external and connected to image forming devices with which the exemplary controller 70 may be associated.

It should be appreciated that, although depicted in FIG. 11 as an integral unit, the various disclosed elements of the exemplary controller 70 may be arranged in any combination of subsystems as individual components or combinations of components, integral to a single unit, or external to, and in wired or wireless communication with the single unit of the exemplary control system. In other words, no specific configuration as an integral unit or as a support unit is to be implied by the depiction in FIG. 11. Further, although depicted as individual units for ease of understanding of the details provided in this disclosure regarding the exemplary controller 70, it should be understood that the described functions of any of the individually-depicted components, and particularly each of the depicted control devices, may be undertaken, for example, by one or more processors 74 connected to, and in communication with, one or more data storage device(s) 76.

Figure 12:
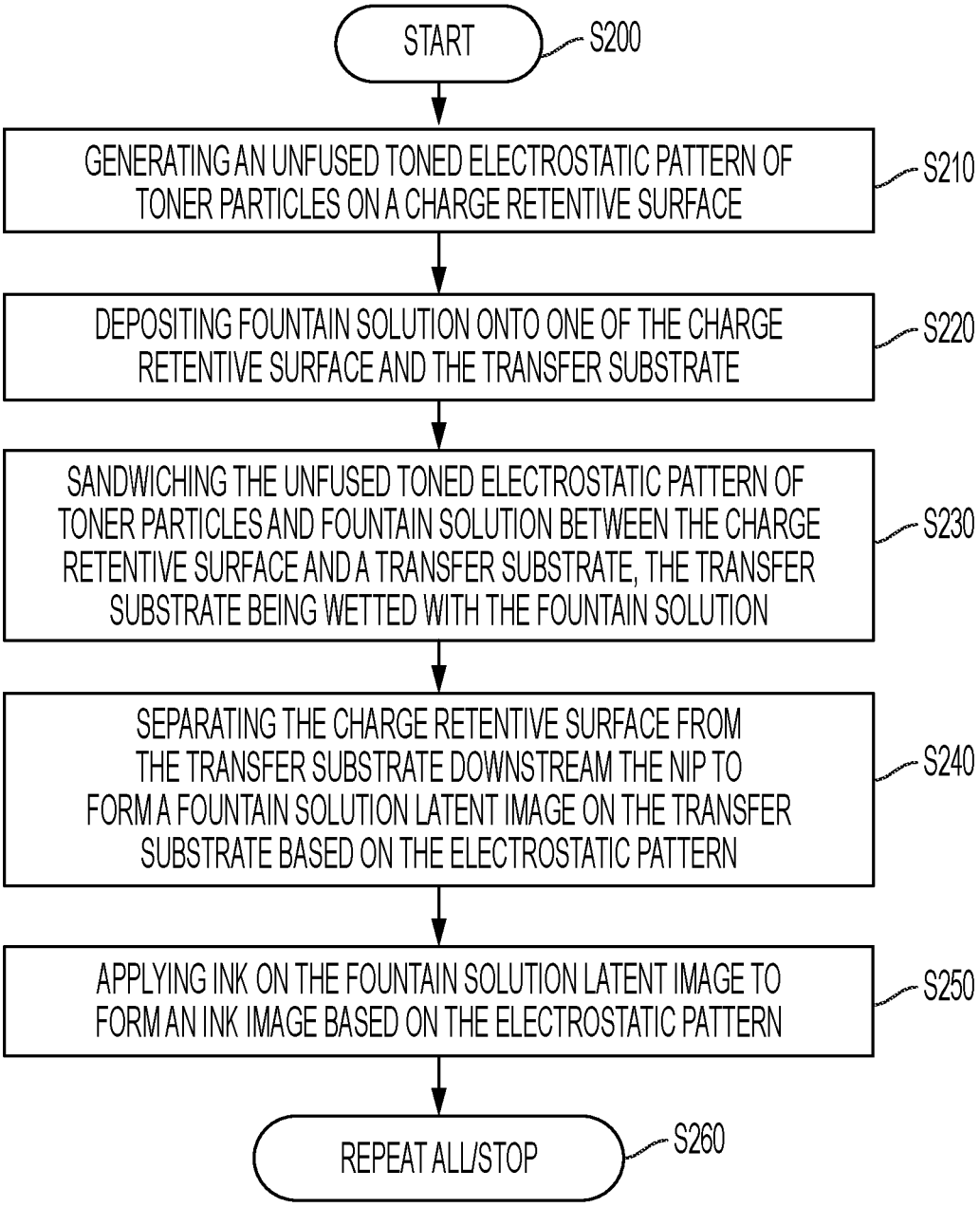
FIG. 12 is a flowchart depicting the operation of a digital image forming device in accordance with examples.

The disclosed embodiments may include an exemplary method for making a fountain solution latent image with the digital image forming devices 100, 125, 130 from which an inked image may be printed. FIG. 12 illustrates a flowchart of such an exemplary method. As shown in FIG. 12, operation of the method commences at Step S200 and proceeds to Step S210.

At Step S210, an unfused toned electrostatic pattern of toner particles is generated on a charge retentive surface. This may include generating an electrostatic charged pattern on the charge retentive surface with an imaging station, and depositing an unfused toner at the charge retentive surface with a toner dispenser. The toner attaches to the charge retentive surface at the electrostatic charged pattern to form the unfused toned electrostatic pattern. The unfused toned electrostatic pattern may include toner particles grouped into piles having interstices between the toner particles. The piles may form a sponge of the toner particles, and the sponge may be compressible. The toner particles may lack color pigment and appear transparent or translucent. While not being limited to a particular theory, the toner particles do not become part of a printed image.

Operation of the method proceeds to Step S220, where a fountain solution applicator may deposit fountain solution vapor and/or fluid onto an adjacent surface, which may be the charge retentive surface that has the unfused toner particles thereon, or a transfer substrate (e.g., inking member transfer member surface, transfer roll surface). Deposited fountain solution vapor may condense on the adjacent surface. In examples, the deposited fountain solution is at least substantially free of surfactants and particulates and is not attracted to or repulsed from the electrostatic charged pattern. The piles of toner particles may wick the fountain solution into the interstices.

Operation of the method proceeds to Step S230, where the unfused toned electrostatic pattern of toner particles and fountain solution are sandwiched at a nip between the charge retentive surface and the transfer substrate. If not wetted previously from the fountain solution deposition, the transfer substrate is wetted with the fountain solution via the sandwiching. A fountain solution latent image with the disposed fountain solution may be formed on the inking blanket 12 of the transfer member 14 under pressure at the loading nip 48.

Operation of the method proceeds to Step S240, where the charge retentive surface and the transfer substrate are separated downstream the nip. Upon the separation the unfused toned electrostatic pattern of toner particles remains on the charge retentive surface only and the transfer substrate remains wetted with the fountain solution patterned as a fountain solution latent image based on the electrostatic pattern.

At Step S250, ink may be applied on the fountain solution latent image and transfer substrate to form an ink image based on the electrostatic pattern. The latent image may be a positive image or negative image. The fountain solution latent image may be used to reject inking or facilitate inking, as readily understood by a skilled artisan. The inked image may then be printed on a print substrate. Operation may cease at Step S260, or may continue by repeating back to Step S210, for generating additional unfused toned electrostatic patterns.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 12, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An automated fountain solution imaging method for making a fountain solution latent image, comprising:

A) generating an unfused toned electrostatic pattern of toner particles on a charge retentive surface;

B) sandwiching the unfused toned electrostatic pattern of toner particles and fountain solution at a nip between the charge retentive surface and a transfer substrate, the transfer substrate being wetted with the fountain solution; and C) separating the charge retentive surface from the transfer substrate downstream the nip, wherein upon the separation the unfused toned electrostatic pattern of toner particles remains on the charge retentive surface only and the transfer substrate remains wetted with the fountain solution patterned as a fountain solution latent image based on the electrostatic pattern, wherein the fountain solution latent image is a negative of the electrostatic pattern.

2. The method of claim 1, Step A) including generating an electrostatic charged pattern on the charge retentive surface, and depositing an unfused toner at the charge retentive surface, with the toner attaching to the charge retentive surface at the electrostatic charged pattern to form the unfused toned electrostatic pattern.

3. The method of claim 2, wherein the electrostatic charged pattern does not affect the fountain solution.

4. The method of claim 1, further comprising, before Step B), depositing the fountain solution onto the transfer substrate.

5. The method of claim 1, further comprising, before Step B), depositing the fountain solution onto the charge retentive surface.

6. The method of claim 1, wherein the unfused toned electrostatic pattern includes toner particles grouped into piles having interstices between the toner particles.

7. The method of claim 6, further comprising, before Step B), depositing the fountain solution onto the unfused toned electrostatic pattern, the piles of toner particles wicking the fountain solution into the interstices.

8. The method of claim 1, further comprising, before Step B), depositing the fountain solution as a vapor at the charge retentive surface, and maintaining the charge retentive surface at a temperature that physisorbs condensation of the fountain solution vapor thereon and forms a uniformly thick fountain solution layer, the unfused toned electrostatic pattern having a surface free energy lower than a surface free energy of the charge retentive surface such that upon depositing the fountain solution vapor at the charge retentive surface, the unfused toned electrostatic pattern inhibits physisorption of the fountain solution thereon.

9. The method of claim 1, wherein the Step A) generates the unfused toned electrostatic pattern of toner particles as a patterned compressible sponge of the toner particles on the charge retentive surface.

10. The method of claim 1, wherein the toner particles lack color pigment.

11. The method of claim 1, further comprising applying ink on the fountain solution latent image to form an ink image based on the electrostatic pattern.

12. A device for making a fountain solution latent image, comprising:

a charge retentive surface having an unfused toned electrostatic pattern of toner particles adhered thereto via electrophotography;

a transfer substrate adjacent the charge retentive surface and forming a nip therebetween, the transfer substrate configured to sandwich the unfused toned electrostatic pattern of toner particles and fountain solution against the charge retentive surface at the nip; and the charge retentive surface and the transfer substrate separated downstream the nip, wherein upon the separation the unfused toned electrostatic pattern of toner particles remains on the charge retentive surface only and the transfer substrate remains wetted with the fountain solution patterned as the fountain solution latent image based on the electrostatic pattern, wherein the fountain solution latent image is a negative of the electrostatic pattern.

13. The device of claim 12, wherein the unfused toned electrostatic pattern includes toner particles grouped into piles having interstices between the toner particles, wherein the piles of toner particles wick the fountain solution into the interstices.

14. The device of claim 12, wherein the toner particles lack color pigment.

15. The device of claim 12, wherein the charge retentive surface is nonconductive.

16. The device of claim 12, wherein the transfer substrate is an imaging blanket, and one of the charge retentive substrate and the imaging blanket is conformable.

17. The device of claim 12, wherein the unfused toned electrostatic pattern of toner particles is a patterned compressible sponge of the toner particles.

18. The device of claim 12, further comprising a fountain solution deposition unit adjacent the transfer substrate, the fountain solution deposition unit configured to deposit the fountain solution onto the transfer substrate upstream the nip.

19. A system for making a fountain solution latent image, comprising:

a processor and a memory, the memory storing instructions to cause the processor to perform:

generating an unfused toned electrostatic pattern of toner particles on a charge retentive surface;

sandwiching the unfused toned electrostatic pattern of toner particles and fountain solution at a nip between the charge retentive surface and a transfer substrate, the transfer substrate being wetted with the fountain solution; and separating the charge retentive surface from the transfer substrate downstream the nip, wherein upon the separation the unfused toned electrostatic pattern of toner particles remains on the charge retentive surface only and the transfer substrate remains wetted with the fountain solution patterned as a fountain solution latent image based on the electrostatic pattern, wherein the fountain solution latent image is a negative of the electrostatic pattern.

20. The system of claim 19, the memory storing instructions to cause the processor to further perform depositing the fountain solution onto the transfer substrate upstream the nip.

* * * * *